United States Patent [19]

Farr

[11] Patent Number: 4,945,248

[45] Date of Patent: Jul. 31, 1990

[54] HYDROACTIVATED BIONIC INFRARED SOURCE

[75] Inventor: John F. Farr, Woodbridge, Va.

[73] Assignee: The United States of America as represented by the Secretary of the Army, Washington, D.C.

[21] Appl. No.: 337,213

[22] Filed: Apr. 12, 1989

[51] Int. Cl.[5] ..... F21K 7/00

[52] U.S. Cl. ..... 250/493.1; 250/504 R; 44/3.3; 44/3.8

[58] Field of Search ..... 250/493.1, 343, 504 R; 364/122; 44/3.3, 3.8

[56] References Cited

U.S. PATENT DOCUMENTS

| | | | |
|---|---|---|---|
| Re. 31,023 | 9/1982 | Hall III | 364/172 |
| 1,899,286 | 2/1933 | Meagher | 44/3.3 |
| 3,578,974 | 5/1971 | Thomas et al. | 250/493.1 |
| 3,780,308 | 12/1973 | Nablo | 250/493.1 |
| 3,797,395 | 3/1974 | Tyroler | 250/493.1 |
| 3,878,396 | 4/1975 | Vallet | 250/493.1 |
| 4,338,098 | 7/1982 | Yamaji | 44/3.3 |
| 4,435,645 | 3/1984 | Bartle | 250/493.1 |
| 4,740,086 | 4/1988 | Oehler et al. | 250/343 |

*Primary Examiner*—Jack I. Berman
*Assistant Examiner*—Kiet T. Nguyen
*Attorney, Agent, or Firm*—Milton W. Lee; Aubrey J. Dunn; Anthony T. Lane

[57] ABSTRACT

A waterproof container such as a plastic or treated paper bag is filled with a dry biodegradable vegetable material such as hay, grass clippings, wood shavings, etc. When water is added to the container to wet its contents, the normally-occurring micro-organisms on the vegetable matter decompose it and release heat.

1 Claim, 1 Drawing Sheet

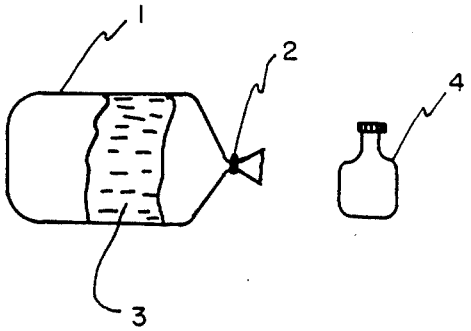
1
2
4
3

HYDROACTIVATED BIONIC INFRARED SOURCE

The invention described herein may be manufactured, used, and licensed by the U.S. Government for governmental purposes without the payment of any royalties thereon.

BACKGROUND OF INVENTION

This invention is in the field of activatable infrared emitters. Such emitters have various uses, such as decoys and markers and are becoming more important with the increases in number and use of infrared detectors and imagers. For point sources, incandescent light bulbs are excellent, but for larger or more diffuse sources, other schemes must be used. U.S. Pat. No. 3,878,396, for example, shows an infrared source which is activated when water is added to a mixture of $P_2O_5$, BaO, and manganese nitride. U.S. Pat. No. 3,596,098 shows an infrared source in the shape of a disc, with a pyrotecnic material contained within and confined to the disc as the material acts. These schemes seem to work fine for their intended purposes, but none fills the need for an extremely cheap, readily activatable, diffuse infrared source with indefinite storage life and a relatively long service life. The instant invention fills this need, and can be readily made in the field with locally-procured materials.

SUMMARY OF THE INVENTION

The invention is a diffuse infrared emitter in the form of a hydroactivated bionic mass. In particular, it consists of dry vegetable matter in a waterproof container, which when activated by water, decomposes from the action of bacteria or fungus normally on the matter and emits infrared radiation. A bacterial or fungal culture may be added to enhance decomposition.

BRIEF DESCRIPTION OF THE DRAWINGS

The single drawing FIGURE is a pictorial view, partially cut away, of the invention.

DESCRIPTION OF PREFERRED EMBODIMENT

Turning now to the drawings, we see the infrared source in its simplest form. This consists of a container 1 of a waterproof material such as plastic or treated paper. For simplicity, this container is in the form of a bag secured by closure 2. Within the bag is dry vegetable matter 3 such as grass clippings, hay, wood shavings, leaves, etc. In container 4 is stored water, which is used to activate the infrared source. Before activation, container 1 is kept tightly closed to exclude water; when water from container 4 is added (to thoroughly wet the vegetable matter), the normal bacteria or fungus on the vegetable matter begins to rapidly reproduce and biodegrade the vegetable matter. The biodegradation produces water, organic by-products such as methane, carbon dioxide, and heat. The amount of heat, in which we are interested, depends upon such factors as ambient temperature, the particular vegetable matter used, the number and kind of bacteria or fungus on the vegetable matter, and the amount of water orginally added. The heat output spectrum of the source is similar to the output spection of the human body, and will be in the range of 10°–15° C. above ambient temperature. Operation of the source may be enhanced by seeding the vegetable matter with additional bacteria or fungi, such as the commercially available types used in septic tanks.

Obviously, the instant infrared source may be made in any size and shape to simulate various targets, or may be used as markers, may be readily made essentially any place on earth from locally-obtained vegetable matter, will have indefinite storage life (if kept dry), and, when activated, will emit radiation for long times (days to months).

Variations are possible within the scope of the invention which would make it handier to use. For example, the water may be stored in a frangible container within the vegetable matter container, such that the emitter may be activated by breaking the frangible container without opening the vegetable matter container. Alternatively, the water may be contained in a bladder, with a rip cord extending out of the vegetable matter container.

Although the above description is directed to the invention using dry vegetable matter already contained in a waterproof container, it may be desirable to leave the invention in an unassembled state until such time as it is needed. This is because it is difficult to thoroughly dry vegetable matter such that it will not spontaneously begin decomposing in a waterproof container, even without the addition of extra water. Even a slight amount of moisture in the container is sufficient for decomposition to begin; the additional moisture produced by the decomposition (and retained by the container) will enhance the decomposition already in progress.

I claim:

1. A hydroactivated bionic infrared source including a biomass in a waterproof container, wherein said biomass includes desiccated micro-organisms and a dehydrated culture medium for said micro-organisms, and means for releasing water in said container, whereby the release of water activates said micro-organisms to begin rapidly consuming said medium and to emit infrared radiation.

* * * * *